US007217896B1

(12) United States Patent
Skarlupka et al.

(10) Patent No.: US 7,217,896 B1
(45) Date of Patent: May 15, 2007

(54) STAKED PRINTED CIRCUIT BOARD TERMINALS FOR SWITCH CASES

(75) Inventors: Michael J. Skarlupka, Freeport, IL (US); Mark A. Mantua, Freeport, IL (US); Gary W. Eisenhower, Freeport, IL (US); Matthew J. Brose, Pecatonica, IL (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/339,950

(22) Filed: Jan. 25, 2006

(51) Int. Cl.
*H01H 1/00* (2006.01)

(52) U.S. Cl. ..... 200/284; 200/332

(58) Field of Classification Search ..... 200/284, 200/294, 295, 332, 335, 339
See application file for complete search history.

(56) References Cited

U.S. PATENT DOCUMENTS 4,168,405 A * 9/1979 Raab et al. ..... 200/1 V
4,739,139 A * 4/1988 Ikeda ..... 200/294
4,778,964 A * 10/1988 Kamisada ..... 200/284
6,710,273 B1 * 3/2004 Skarlupka et al. ..... 200/302.3
6,713,696 B1 3/2004 Skarlupka et al. ..... 200/302.3
6,791,047 B1 * 9/2004 Skarlupka et al. ..... 200/335
2003/0228778 A1 * 12/2003 Shang ..... 439/172

* cited by examiner

*Primary Examiner*—Michael Friedhofer
*Assistant Examiner*—Lisa Klaus
(74) *Attorney, Agent, or Firm*—Kermit D. Lopez; Luis M. Ortiz

(57) ABSTRACT

A staked terminal rivet system and method configured to mount a switch device onto a printed circuit board is disclosed as an alternative to traditional molded-in or staked-on secondary terminal systems. An electrically conductive rivet functioning as a terminal reduces overall manufacturing costs and provides a higher degree of precision for mounting onto printed circuit boards. This technology has wide ranging applicability, including: industrial machinery and equipment, commercial aviation, test instrumentation, agricultural machinery, process control and medical instrumentation.

12 Claims, 3 Drawing Sheets

BEFORE

AFTER

STAKED PRINTED CIRCUIT BOARD TERMINALS FOR SWITCH CASES

TECHNICAL FIELD

Embodiments are generally related to switching devices, particularly those devices which can be mounted onto a printed circuit board. Embodiments are further related to staked printed circuit board terminals.

BACKGROUND

Switches are devices utilized to manually control electric current flow. Current applications for switches can be found across nearly all electronic arts. Common switch types include push-button, rocker, toggle, rotary, key-lock, slide, snap-action and reed. Toggle switches in particular, are actuated via an attached lever which is moved to open or close the electrical circuit.

Switches are highly varied based on their intended utility. Such examples include: standard size basics, miniature, subminiature, hermetically sealed, high temperature and special application switches. Precision snap-action switch devices are available with a wide variety of actuators and operating characteristics. These switch systems are often ideal for applications requiring compactness, light weight, accurate repeatability and long life. This family also includes push-buttons, toggles, rockers, key switches and indicators for use where manual operation is desired.

Standard precision switches are used in simple or precision on/off applications. These devices combine small size and low weight with ample electrical capacity to promote precision operation and long-life.

Sealed and high-temperature precision switches are used in many of the harsh environments encountered in aerospace, transportation, ordnance and marine applications. Some of these devices are enclosed within a corrosion-resistant housing to seal precision switch contacts from contamination.

Current switch systems are mounted to a printed circuit board using electrically conductive terminals which are molded into the switch housing assembly. Molding the terminals into the housing results in significant costs in the design of new molds for various applications. An alternative method used today is by staking a secondary terminal onto the switch housing assembly. However, this technique can result in mis-alignment when mated with the printed circuit board.

The staked printed circuit board terminals provide an alternative to traditional molded-in or staked-on secondary terminal systems, in that they are cheaper to manufacture (e.g. no new costs for molds), easier to implement in mass production, and offer a higher degree of precision for mounting onto printed circuit boards. This technology has wide ranging applicability in many disciplines, including: industrial machinery and equipment, commercial aviation, test instrumentation, agricultural machinery, process control and medical instrumentation.

Referring to FIG. 1, a diagram 100 illustrates an example of a prior art switch device with molded-in terminals, wherein a toggle switch actuator 110 is operatively connected to molded-in terminals 130, which are encased inside the switch housing assembly 120. The switch housing assembly 120 is depicted transparently for illustrative purposes.

BRIEF SUMMARY

The following summary is provided to facilitate an understanding of some of the innovative features unique to the present invention and is not intended to be a full description. A full appreciation of the various aspects of the invention can be gained by taking the entire specification, claims, drawings, and abstract as a whole.

It is therefore one aspect of the present invention to provide for an improved switching device.

It is another aspect of the present invention to provide for a switching device that can be mounted to a printed circuit board (PCB).

It is a further aspect of the present invention to provide for a staked terminal rivet system comprising an electrically conductive rivet functioning as a terminal operatively connected to a printed circuit board, a switch housing assembly operatively connecting a switch device to the terminal rivet, and an optional spacing component functioning as a mounting interface between the terminal rivet and the switch housing assembly.

In accordance with another feature, there is provided a ring-staked terminal switch system comprising an electrically conductive ring-staked rivet terminal operatively connected to a printed circuit board, a plastic toggle switch housing assembly operatively connecting a toggle switch device to said ring-staked rivet terminal, and a metallic spacing component functioning as a mounting interface for said ring-staked rivet terminal and said switch housing assembly.

Other disclosed features of the embodiments include a method of employing a staked terminal rivet system to operatively connect a switch device to a printed circuit board comprising placing a spacing component functioning as a mounting interface on top of a switch housing assembly and then inserting an electrically conductive rivet into the spacing component and the switch housing assembly. Next, the electrically conductive rivet is staked onto the spacing component and the staked terminal rivet system is attached to a printed circuit board.

In general, a ring-staked terminal switch system can be provided that includes an electrically conductive ring-staked rivet terminal operatively connected to a printed circuit board, wherein the rivet is provided with a protruding portion. Such a ring-staked terminal switch system further includes a switch housing assembly operatively connecting a switch device to the electrically conductive ring-staked rivet terminal, wherein the switch device is configured as a toggle switch and wherein the switch device is environmentally sealed from liquids and particulates. Finally, such a ring-staked terminal switch system can include a metallic ring-shaped spacing component functioning as a mounting interface for the electrically conductive ring-staked rivet terminal and the switch housing assembly. The staked rivet terminal can be configured from a material such as silver or gold.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate at least one embodiment of the present invention and are not intended to limit the scope of the invention.

Figure 1:
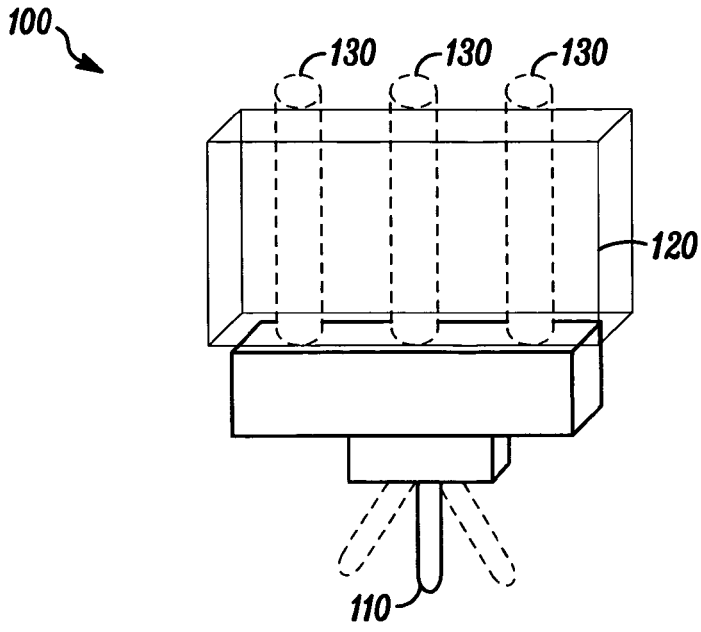
(PRIOR ART) FIG. 1
FIG. 1 illustrates a diagram depicting an example of a prior art switch device with molded-in terminals for general edification and background purposes.
Figure 2:
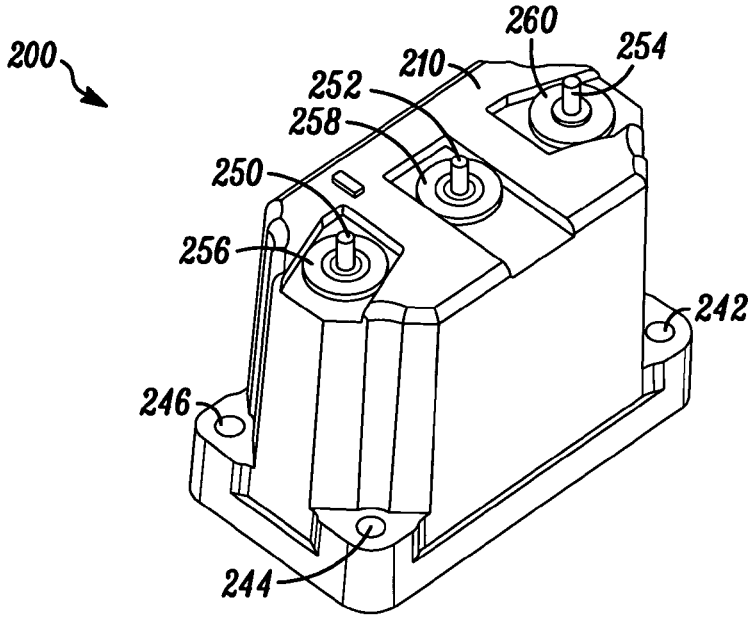
FIG. 2 illustrates a diagram depicting a staked terminal rivet system comprising one or more electrically conductive rivets that each function as terminals which can be operatively connected to a Printed Circuit Board (PCB) in accordance with a preferred embodiment.

FIG. 2 illustrates a top perspective view of a staked terminal rivet system 200 comprising a plurality of electrically conductive rivets 250, 252, and 254, which can function as terminals operatively connected to a Printed Circuit Board (PCB), which is not shown in FIG. 2. The system 200 further includes a switch housing assembly 210, which can operatively connect a switch device to the terminal rivets 250, 252 and 254. Note that terminal rivets 250, 252 are configured as staked terminal rivets, while rivet 254 is illustrated as an unstaked terminal rivet.

One or more optional spacing components 256, 258, and 260 are also provided, which are respectively associated with electrically conductive rivets 250, 252, and 254. The spacing components, 256, 258, and 260 can be provided in the form of brass washers, depending upon design considerations. The optional spacing components 256, 258, and 260 can function as a mounting interface between the terminal rivets 250, 252, and 254 and the switch housing assembly 210, which can be implemented in accordance with a preferred embodiment. Note that the switch housing assembly 210 can be configured to include one or more holes 242, 244, 246, which can receive screws or other connecting components for attaching the switch housing assembly 210 to the switch cover assembly. Note that the switch cover assembly is not shown in the figures because the embodiments illustrated herein are concerned with the actual switch housing assembly 210 rather than the switch cover assembly, which merely connects to the switch housing assembly 210.

Figure 3A:
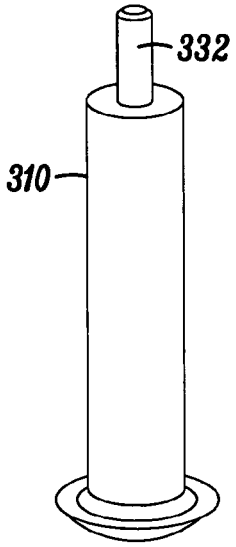
FIGS. 3(*a*) and 3(*b*) respectively illustrate diagrams depicting contact rivets before and after a ring staking operation, in accordance with a preferred embodiment.
Figure 3B:
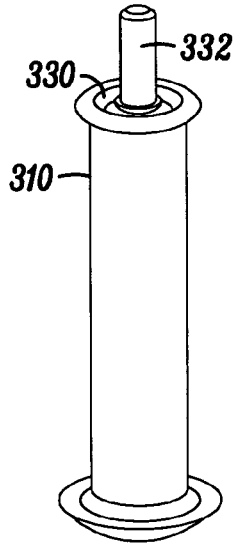

FIGS. 3(*a*) and 3(*b*) respectively illustrate diagrams depicting contact rivets before and after a ring-staking operation is performed, in accordance with a preferred embodiment. Referring to FIG. 3(*a*), a terminal rivet 310 is depicted prior to a ring-staking operation and is analogous to the unstaked terminal rivet 254 depicted in FIG. 2. Following the implementation of a ring staking operation as indicated in FIG. 3(*b*), a portion of the rivet 330 is plastically deformed. The rivet component 332 which protrudes from the terminal 310 can connect into a Printed Circuit Board (PCB) via thru hole soldering. The rivet configuration depicted in FIG. 3(*b*) is similar to the ring-staked terminal rivets 250 and/or 252 depicted in FIG. 2.

Figure 4:
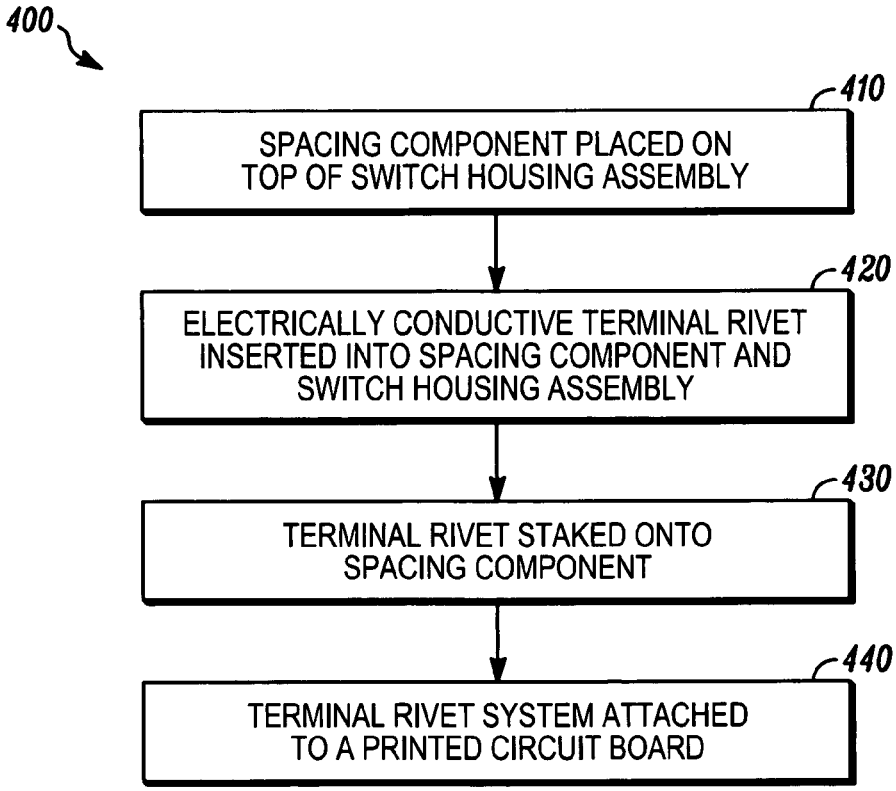
FIG. 4 depicts a high-level flow chart of operations illustrating logical operational steps that can be followed for installing a staked terminal rivet system to operatively connect a switch device to a printed circuit board in accordance with a preferred embodiment.

Referring to FIG. 4, a flow chart 400 illustrating the process employed in installing a staked terminal rivet system to operatively connect a switch device to a printed circuit board which can be adapted for use in accordance with a preferred embodiment is shown. Although a variety of process steps are depicted in FIG. 4, it can be appreciated that the order of the steps is for general illustrative purposes only and that the steps indicated in FIG. 4 can be implemented in a different order, depending upon design considerations.

As indicated at block 410, an optional spacing component can be placed on top of the switch housing assembly as described in block 410. Once the optional spacing component is positioned into place, an electrically conductive terminal rivet is inserted into the optional spacing component and switch housing assembly as described in block 420. Next, the terminal rivet can be staked onto the optional spacing component as illustrated at block 430. Finally, the terminal rivet system can be attached to a printed circuit board as illustrated at block 440.

Figure 5:
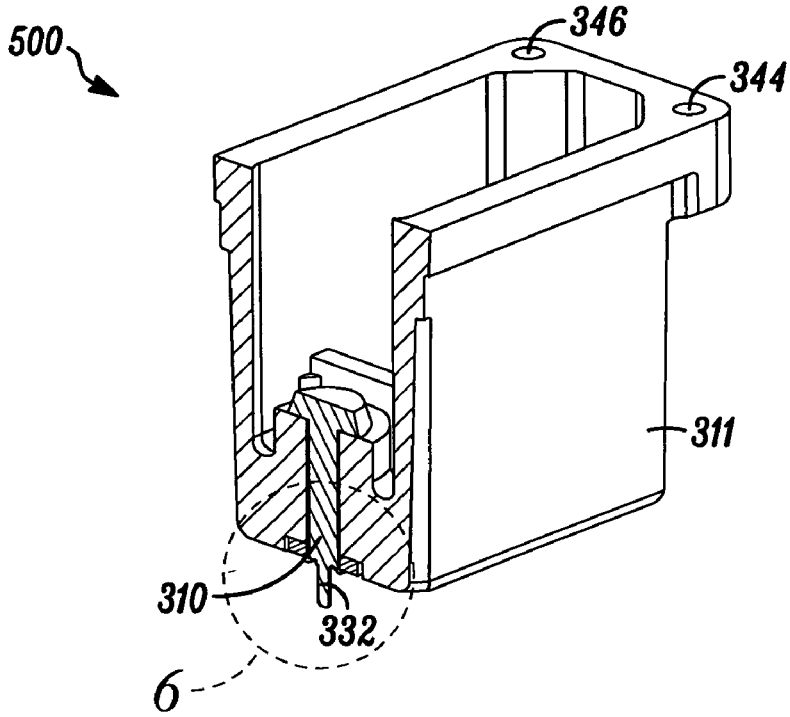
FIG. 5 illustrates a rear perspective view of a staked terminal rivet system, which can be implemented in accordance with a preferred embodiment.
Figure 6:
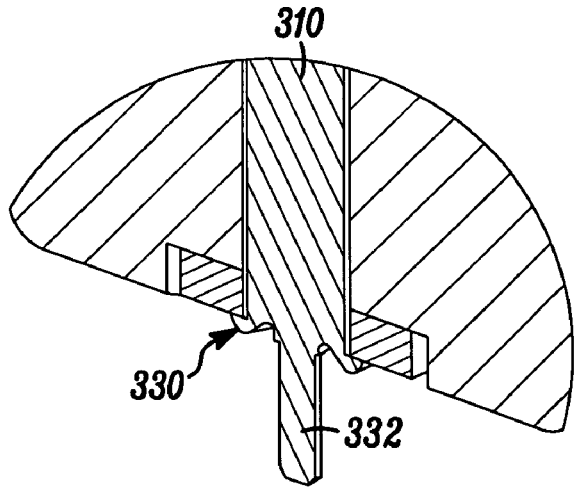
FIG. 6 illustrates a detailed version of a portion of the staked terminal rivet system depicted in FIG. 5 in accordance with a preferred embodiment.

FIG. 5 illustrates a rear perspective view of a staked terminal rivet system 500, which can be implemented in accordance with a preferred embodiment. FIG. 6 illustrates a detailed version of a portion of the staked terminal rivet system 500 depicted in FIG. 5 in accordance with a preferred embodiment. Note that in FIGS. 3(*a*)–3(*b*) and FIGS. 5–6, identical or similar parts or elements are generally indicated by identical reference numerals.

System 500 depicted in FIGS. 5–6 essentially represents a cross sectional view of the system 200 depicted in FIG. 2 The holes 344, 346 depicted in FIG. 5 are analogous to the hole 242 and its associated hole (not shown) depicted in FIG. 2. The holes 344, 346 are formed in a switch housing assembly 311, which is analogous to the switch housing assembly 210 depicted in FIG. 2. The switch housing assembly or case 311 can be formed from plastic, depending upon design considerations.

The ring staking operation described herein results in the deformation of the contact rivet material as indicated by the deformed portion 330 depicted in FIG. 6. The terminal 310 shown in FIGS. 3(*a*)–3(*b*) is also depicted in FIGS. 5–6. Note that the terminal rivet 310 can be formed from material, such as, gold or silver, depending upon design considerations.

According to the disclosed embodiments, the rivet 310 can be produced with a center protruding tip for connection to a PCB with thru-hole board mounting. A ring-staking operation can be used to stake the flat portion of the terminal 310 from which the protrusion 332 extends. Brass washers (e.g., spacing components 256, 258, 260) can be placed between the case and the rivet to prevent the plastic case (e.g., assembly 210 or assembly 311) from being crushed during the staking process.

It will be appreciated that various of the above disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A staked terminal rivet system, comprising:

an electrically conductive rivet comprising a terminal rivet, which is operatively connectable to a printed circuit board;

a switch housing assembly operatively connected to a switch device to said terminal rivet, wherein said rivet is provided with a protruding portion thereof for improved alignment in mating said printed circuit board to said switch housing assembly; and a mounting interface between said terminal rivet and said switch housing assembly, wherein said switch device is environmentally sealed from liquids and particulates and can operate in a range of temperatures between approximately -85 degrees Fahrenheit to approximately 160 degrees Fahrenheit.

2. The system of claim 1 wherein said switch housing assembly comprises a material containing plastic.

3. The system of claim 1, wherein said switch device is configured as a toggle switch.

4. The system of claim 3 wherein said switch device is actuated in at least two different positions.

5. The system of claim 1 wherein said electrically conductive rivet is configured from a material comprising gold.

6. The system of claim 1 wherein said electrically conductive rivet is configured from a material comprising silver.

7. The system of claim 1 further comprising a spacing component comprising said mounting interface between said terminal rivet and said switch housing assembly.

8. The system of claim 7 wherein said spacing component is configured in a polygonal shape.

9. The system of claim 7 wherein said spacing component comprises a material formed from brass.

10. A ring-staked terminal switch system comprising:

an electrically conductive ring-staked rivet terminal operatively connected to a printed circuit board, wherein said rivet is provided with a protruding portion;

a switch housing assembly operatively connecting a switch device to said electrically conductive ring-staked rivet terminal, wherein said switch device is configured as a toggle switch and wherein said switch device is environmentally sealed from liquids and particulates; and a metallic ring-shaped spacing component functioning as a mounting interface for said electrically conductive ring-staked rivet terminal and said switch housing assembly.

11. The system of claim 10 wherein said electrically conductive ring-staked rivet terminal is configured from a material comprising gold.

12. The system of claim 10 wherein said electrically conductive ring-staked rivet terminal is configured from a material comprising silver.

* * * * *